US005402539A

United States Patent [19]

Hewitt

[11] Patent Number: 5,402,539

[45] Date of Patent: Apr. 4, 1995

[54] FIREFIGHTER'S PANTS WITH FLOATING BACK BRACE

[75] Inventor: Joyce A. Hewitt, Alton, N.H.

[73] Assignee: Globe Manufacturing Company, Pittsfield, N.H.

[21] Appl. No.: 155,622

[22] Filed: Nov. 22, 1993

[51] Int. Cl.[6] ..... A41D 1/06

[52] U.S. Cl. ..... 2/227; 2/2; 2/79; 2/44; 2/231

[58] Field of Search ..... 2/2, 227, 44, 79, 81, 2/229, 230, 231, 234, 235, 236, 237, 255, 256; 450/103, 143; 602/13, 19

[56] References Cited

U.S. PATENT DOCUMENTS 3,141,457 7/1964 Davidson ..... 2/227
5,036,548 8/1991 Grilliot et al. ..... 2/227
5,050,244 9/1991 Kleinman ..... 2/227
5,157,790 10/1992 Aldridge ..... 2/227

*Primary Examiner*—Andrew M. Falik
*Assistant Examiner*—Gloria Hale
*Attorney, Agent, or Firm*—Watson, Cole, Grindle & Watson

[57] ABSTRACT

Firefighter's pants include a torso portion having an upwardly extending rear panel. A plurality of loops are permanently connected to the rear part of the torso portion. The loops slidably receive and support a conventional back brace. One of the straps is connected to the rear panel by hook and loop fastener members so that the strap can be partially or totally disconnected from the rear panel. Hook and loop fastener members are also disposed at the front part of the torso portion for engaging cooperating members on a back brace to support the back brace at the front part of the torso portion.

15 Claims, 3 Drawing Sheets

FIREFIGHTER'S PANTS WITH FLOATING BACK BRACE

BACKGROUND OF THE INVENTION

The present invention relates to firefighter's pants and more particularly to such pants incorporating a back brace. Firefighting is of such a nature that it often requires considerable physical exertion by firefighters including the necessity of lifting heavy objects and moving one's body into awkward positions. As a result of this kind of duty, firefighters are liable to injure their backs, and accordingly it is desirable to provide each firefighters with a back brace to prevent injury when fighting fires.

It is, of course, possible for firefighters to separately put on conventional back braces before putting on their firefighter's suits. However, if separate back braces are provided, they may be misplaced. Furthermore, it is a disadvantage to spend time putting on a back brace and a firefighter's suit separately since it is necessary for the firefighter to quickly don his suit in order to arrive at the fire as soon as possible.

Therefore, it is a desirable objective that firefighter's pants incorporate a back brace in such a manner that the pants and the back brace can be put on at the same time with a minimum of effort and without requiring time consuming extra motions.

In the prior art, a back brace has been built into a firefighter's suit and is not provided as a separate item. However, the problem with such a construction is that it does not permit the back brace to "float" with respect to the suit so that the back brace can move with the body of the firefighter as the firefighter's body moves relative to the suit. Therefore, it is a further desirable objective that firefighter's pants incorporate a back brace which is supported by the pants so that the pants and back brace can be put on together in an efficient manner, and yet which will allow the back brace to "float" with respect to the pants, or in other words, the back brace can follow the movements of the body of the firefighter as he moves within the suit.

In addition, it is desirable that the support means for supporting the back brace within the pants is adjustable so that the initial position of the back brace with respect to the pants before being put on can be adjusted for the height of the firefighter so that when the pant are put on, the back brace will be properly positioned on the body of the firefighter.

SUMMARY OF THE INVENTION

All of the above objectives are accomplished in the present invention by providing a unique support means for supporting a conventional back brace in operative position within the pants of a firefighter's suit so that when the firefighter pulls on his pants, the back brace will automatically be properly positioned relative to his body so that he can attach the ends of the belt to one another to support his back and can then quickly fasten the pants in the usual manner. The support means permits the initial position of the back brace to be adjusted according to the height of the firefighter, and when in use, the back brace is adapted to "float" or move with respect to the pants so that the firefighter's movements are not unnecessarily restricted and ensuring that his back is protected from injury at all times.

The support means includes a plurality of straps which are connected o the rear part of the torso portion of the pants. A conventional back brace includes a central part and has opposite ends having attaching means for attaching the ends together to secure the back brace on a body. The central part of the back brace is slidably supported within loops formed by the straps. At least one of these straps is detachably connected by a first connecting means to a back panel which extends upwardly from the back part of the torso portion of the pants. This arrangement permits to straps to be initially adjusted according to the size of the firefighter wherein the connecting means may be partially disconnected. Furthermore, the first connecting means may be completely disconnected during use to permit the back brace to move with the firefighter's body if the firefighter's body should move a considerable distance relative to the pants in the longitudinal direction of the pants. In addition, the slidable relationship of the back brace with respect to the support straps enables the back brace to move laterally with respect to the pants.

Second connecting means is provided for detachably connecting the end portions of the back brace to the front part of the torso portion. The second connecting means is primarily for the purpose of supporting the ends of the back brace in an open position when pulling on the pants. After the pants are in position on the firefighter, the ends of the back brace are attached to one another. Thereafter, it is not important for the second connecting means to be in connecting relationship, and the second connecting means may be completely disconnected to permit the back brace to "float" with respect to the font part of the pants.

The first and second connecting means are of the hook and loop fastener type such as VELCRO so that they can be readily disconnected simply by movement of the body of the firefighter and the back brace with respect to the pants.

DESCRIPTION OF THE PREFERRED EMBODIMENT

Figure 1:
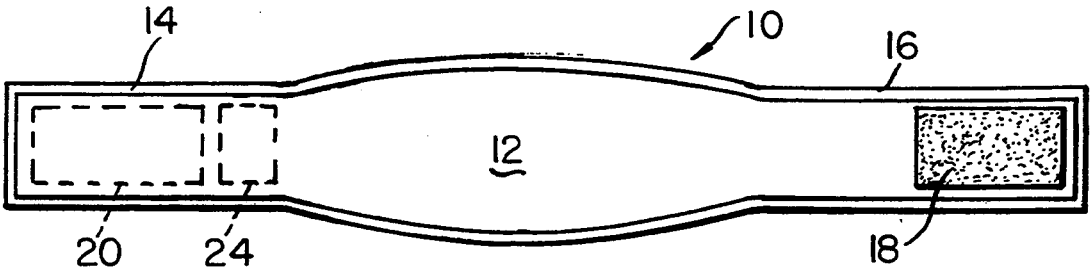
FIG. 1 is a front elevation of a conventional back brace shown in extended position.
Figure 2:
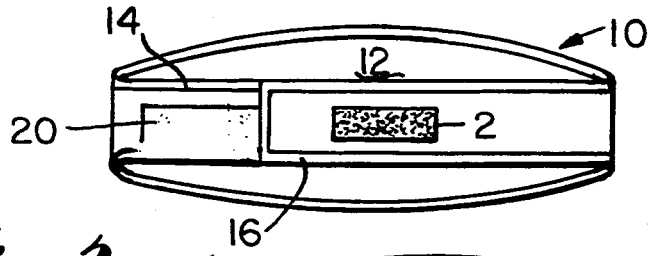
FIG. 2 is a view of the back brace of FIG. 1 shown in its operative position with the opposite ends thereof attached to one another.

Referring now to the drawings wherein like reference characters designate corresponding parts throughout the several views, there is shown in FIGS. 1 and 2 a conventional back brace 10 which may be used in the present invention. It should be understood that any conventional back brace may be suitable for use in the invention, and a typical example is a back brace identified as the AIR BELT, manufactured by Safeguard Technologies, a division of Safety Supply America Corp., Leesport, Pa. The back brace includes a central portion 12 and a pair of opposite end portions 14 and 16. The inner surface of the back brace which is disposed adjacent the body of a wearer is visible in FIG. 1.

A first attachment means 18 in the form of a strip of hook and loop fastener such as VELCRO is fixed to the the inner surface at end portion 16 of the back brace. A second attachment means 20 in the form of a strip of hook and loop fastener such as VELCRO is fixed to the outer surface at the back brace at the other end portion 14. These attachment means are adapted to interengage one another when the belt is in the closed position as shown in FIG. 2. The back brace is of the inflatable type and is provided with a conventional manually operated pumping mechanism 24. A noninflatable back brace may also be used, if desired. A VELCRO hook and loop fastener strip 26 is fixed to the outer surface of the back brace at end 16 thereof and forms a connecting member which cooperates with a connecting member fixed to the pants as hereinafter described.

Figure 3:
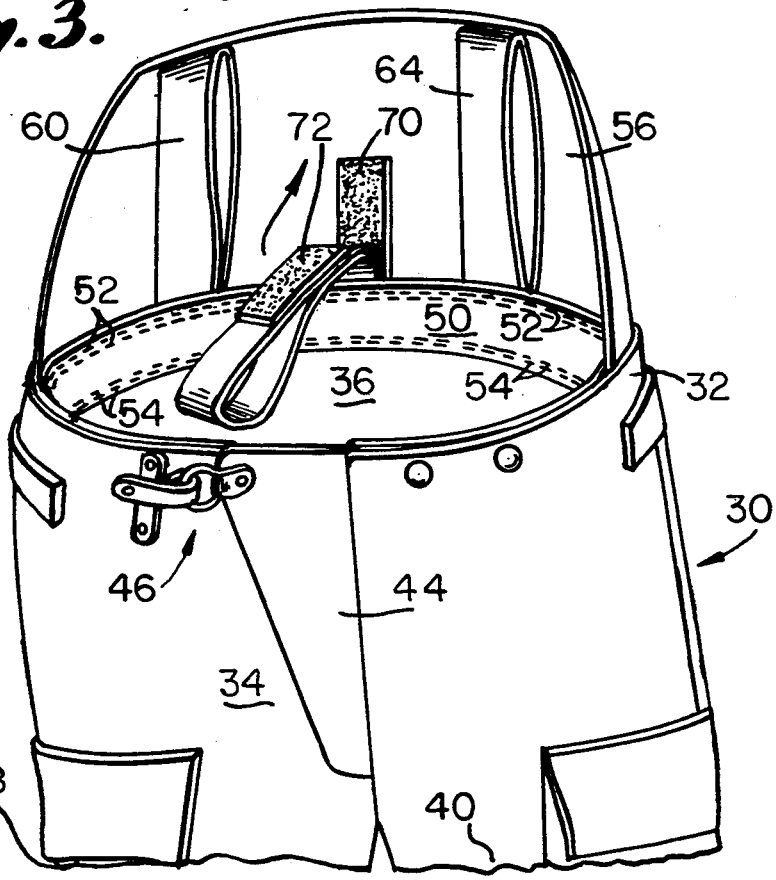
FIG. 3 is a top perspective of a pair of pants incorporating the novel support means of the invention.
Figure 4:
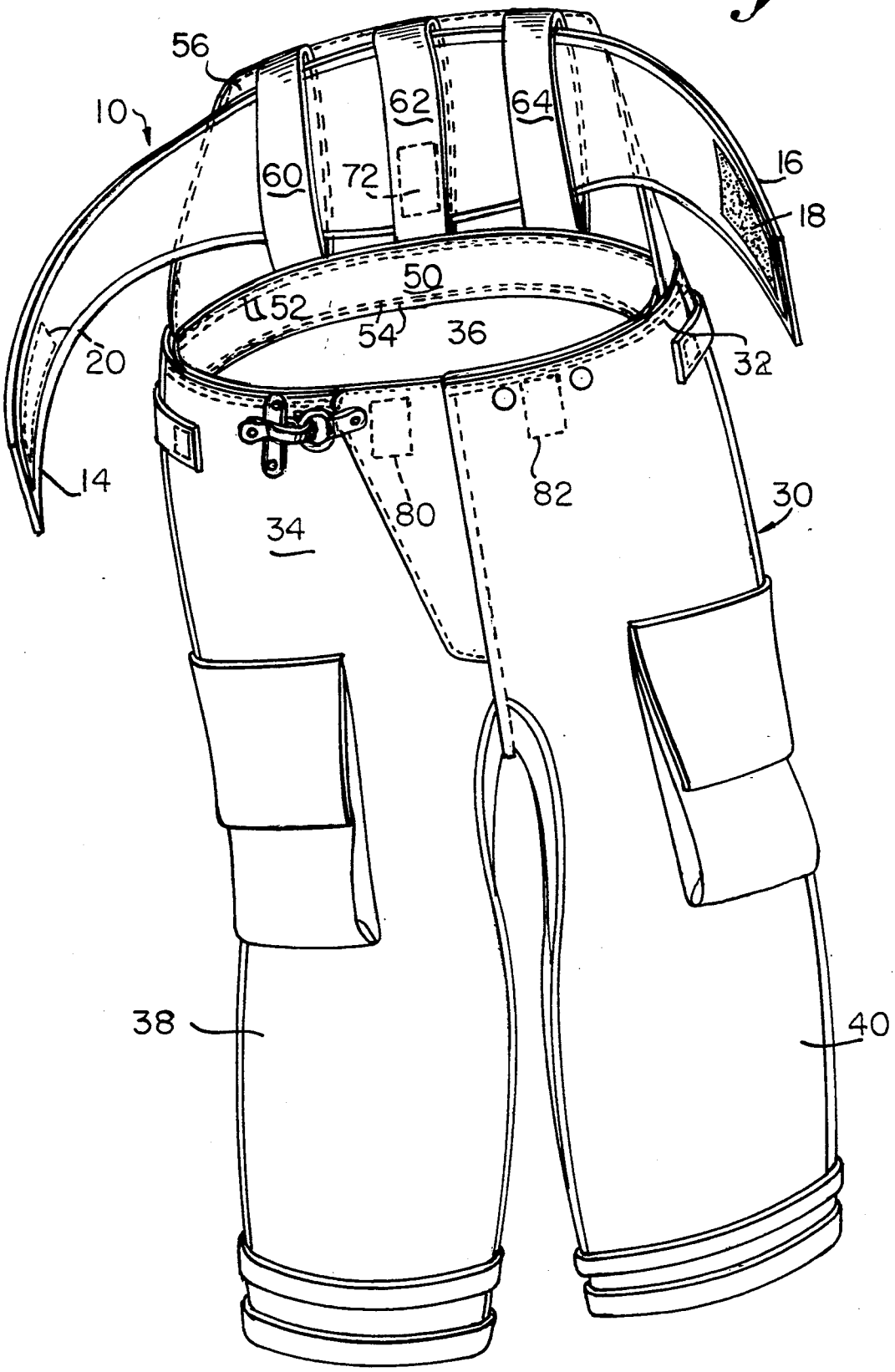
FIG. 4 is a perspective view of a pair of pants with a back brace supported in position therein in a first position.

Referring now to FIGS. 3 and 4, a pair of firefighter's pants are indicated generally by reference character 30 and include a torso portion 32 having a front part 34 and a rear part 36. A pair of leg portions 38 and 40 are connected to the torso portion and extend downwardly therefrom. The front part of the torso portion includes a fly facing 44 and a conventional fastener 46. A waistband 50 extends around the inner periphery of the torso portion and is stitched in place by two double lines of stitching 52 and 54 in the usual manner. The pants comprise an outer shell of fire resistant material and a thermal insulating liner therein as is conventional in the art.

A rear panel 56 is secured by stitching 52 to the rear part of the torso portion and extends upwardly therefrom. This panel ensures that the firefighter is protected when he is bending over, reaching for an object, or crawling which may cause the rear part of the bottom of the coat of the firefighter's suit to ride up away from the rear part of the torso portion of the pants.

Three elongated straps 60, 62 and 64 are provided, each of these straps having opposite end portions which are in abutting relationship with one another and which are connected by stitching 52 to the rear part of the torso portion to define three loops which are adapted to slidably receive and support the central portion of the back brace as shown in FIG. 4. Connecting means is provided for detachably connecting strap 62 to the rear panel and comprises a first elongated connecting member 70 stitched to rear panel 56 and a second elongated connecting member 72 stitched to strap 62. Each of connecting members 70 and 72 comprise strips of hook and loop fastener such as VELCRO. This construction permits interengaging connecting members 70 and 72 to be either partially or totally disconnected from one another.

Connecting members 70 and 72 also serve to properly align strap 62 with respect to the back panel which also enables the opened back brace to be properly aligned with the pants before the pants are pulled on. This is important to ensure that further connecting members at the front part of the torso portion of the pants are properly aligned with connecting members on the ends of the back brace.

Figure 5:
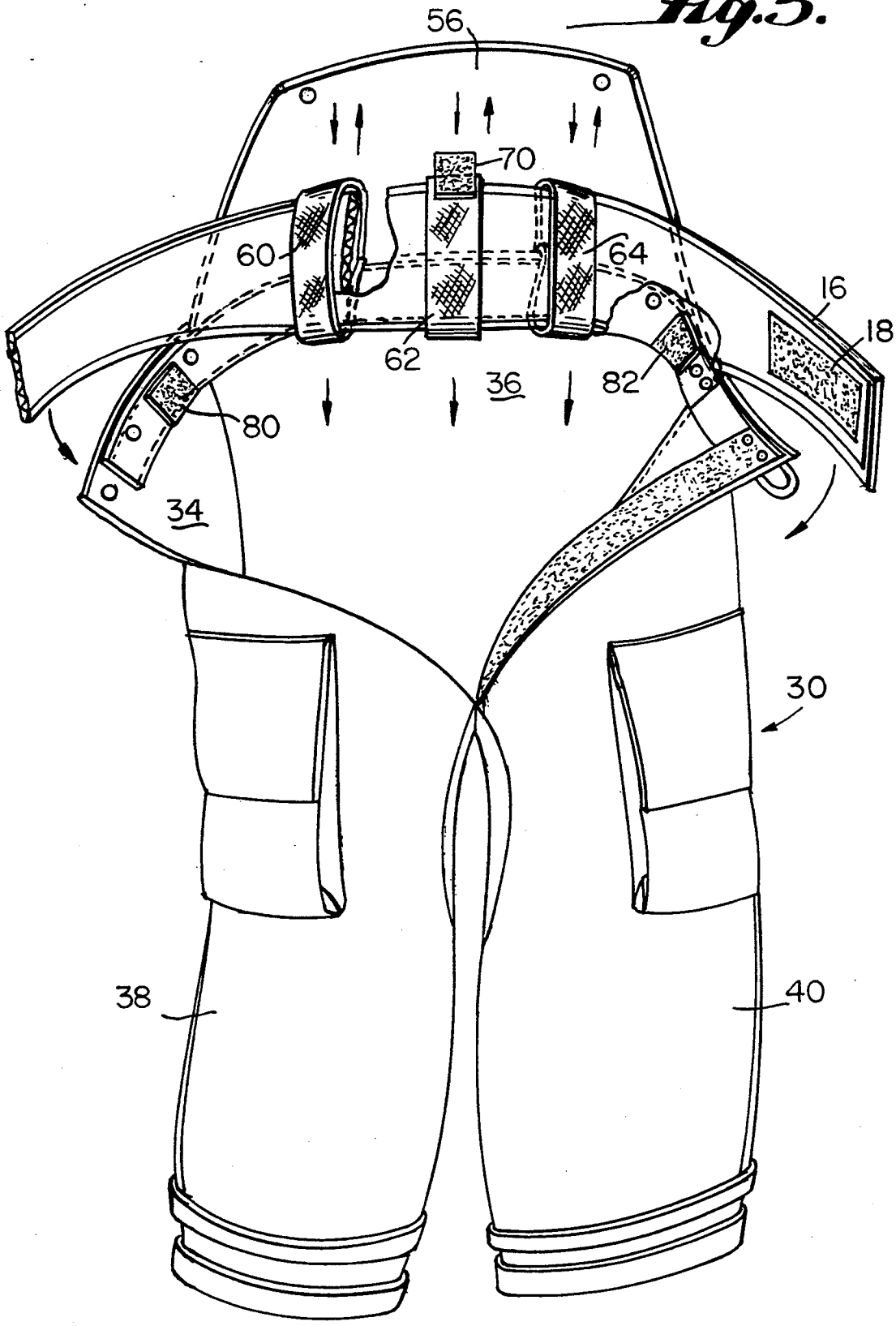
FIG. 5 is a top perspective view of a pair of pants with a back brace supported in a second position.

Referring to FIGS. 4 and 5, further spaced connecting members 80 and 82 formed of hook and loop fastener such as VELCRO are stitched to the inwardly facing surface of the waistband at the front part of the torso portion at opposite sides of the fly. Connecting member 80 is adapted to engage part of attaching means 20 of the back brace, and connecting member 82 is adapted to engage connecting member 26 on the back brace.

As seen in FIG. 4, the back brace is shown as supported in its uppermost position relative to the pants which would be the case with a tall firefighter. In this position, the loops of straps 60, 62 and 64 extend only upwardly from the waistband. In FIG. 5, the back brace is shown as supported in a lower position relative to the pants which would be the case with a shorter firefighter. In this position, a part of each of the straps extends upwardly from a the waistband, while a part of each of the straps extends downwardly from the waistband and connecting members 70 and 72 are partially disengaged from one another. It is is apparent that the loops defined by the straps may be adjusted relative to the pants so that the back brace can be moved upwardly or downwardly as indicated by the arrows to accommodate firefighters of different height.

OPERATION

Assuming that the pants are to be prepared for use by a particular firefighter, the fly of the pants are open and a back brace is inserted through the loops of the three straps. The position of the straps is adjusted so that the back brace will be properly positioned at the waist of the firefighter when he pulls the pants on into operative position. The connecting means between the center strap and rear panel is engaged to a suitable degree depending on the height of the firefighter. The opposite ends of the belt are connected to the front part of the torso portion of the pants. In the case of an inflated back brace, the back brace is already inflated.

The pants are then pulled on in the usual manner, carrying the back brace into position relative to the waist of the firefighter. The opposite ends of the back brace are attached to one another, the fly is closed and the fastener is operated to complete the operation.

Once the pants and back brace are in position as described above, the various connecting means may be disconnected either partially or completely so that the firefighter can move about within the pants as required. In other words, the connecting means between the opposite ends of the back brace and the front of the torso portion as well as the connecting means between the center strap and the rear panel can be readily detached by movement of the firefighter so that the back brace can move with the body of the firefighter and "float" with respect to the pants.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. Firefighter's pants including a a torso portion having a front part and a rear part, a pair of leg portions connected to said torso portion, a rear panel extending upwardly from the rear part of said torso portion, support means comprising a plurality of loops for slidably receiving and supporting a back brace at the rear part of said torso portion, said support means being permanently connected to the rear part of said torso portion, and connecting means for detachably connecting at least a portion of said support means to said rear panel.

2. Firefighter's pants as defined in claim 1 including further connecting means at the front part of said torso portion for supporting a back brace at the front part of said torso portion.

3. Firefighter's pants as defined in claim 1 wherein said connecting means comprises interengaging connecting members mounted on said support means and said rear panel and being so constructed and arranged that the connecting members are adapted to be partially disconnected from one another to adjust the initial position of the support means relative to said back panel depending on the size of a firefighter.

4. Firefighter's pants as defined in claim 3 wherein said connecting members are adapted to be completely disconnected from one another during use so that the support means may move relative to said back panel to allow movement of a firefighter relative to said back panel.

5. Firefighter's pants including a a torso portion having front part and a rear part, a pair of leg portions connected to said torso portion, a rear panel extending upwardly from the rear part of said torso portion, support means for supporting a back brace at the rear part of said torso portion, said support means being permanently connected to the rear part of said torso portion, and connecting means for detachably connecting at least a portion of said support means to said rear panel, said support means comprising a plurality of spaced support members which during use are movable relative to said torso portion and said back panel.

6. Firefighter's pants including a torso portion having a front part and a rear part, a pair of leg portions connected to said torso portion, a plurality of spaced elongated straps each of which has opposite ends, said opposite ends of each of said straps being connected to the rear part of said torso portion to define loops for slidably receiving and supporting a back brace at the rear part of said torso portion, said straps being movable with respect to said torso portion.

7. Firefighter's pants as defined in claim 6 including a rear panel extending upwardly from the rear part of said torso portion, connecting means for detachably connecting one of said straps to said rear panel.

8. Firefighter's pants as defined in claim 7 wherein said connecting means includes interengaging connecting members on one of said straps and on said back panel respectively and being so constructed and arranged that the connecting members are adapted to be partially or totally disconnected from one another to adjust the position of the support means relative to said back panel.

9. Firefighter's pants as defined in claim 6 including connecting means at the front part of said torso portion for supporting a back brace at the front part of said torso portion.

10. In combination, firefighter's pants including a torso portion having a front part and a rear part, a pair of leg portions connected to said torso portion, a rear panel extending upwardly from the rear part of said torso portion, a strap permanently connected to the rear part of said torso portion, first connecting means for detachably connecting said strap to said rear panel, a back brace including a central part and having opposite ends, attaching means for attaching said opposite ends to one another, said central part of the back brace being supported by said strap, and second connecting means for detachably connecting said end portions of the back brace to the front part of said torso portion.

11. Firefighter's pants as defined in claim 10 wherein said first connecting means includes interengaging connecting members on said strap and on said back panel respectively and being so constructed and arranged that the connecting members are adapted to be partially or totally disconnected from one another so that the back brace is adapted to move with a firefighter and float with respect to said torso portion.

12. Firefighter's pants as defined in claim 10 wherein said second connecting means includes interengaging connecting members on the front part of said torso portion and on the ends of said back brace respectively and being so constructed and arranged that these connecting members are adapted to be partially or totally disconnected from one another and the back brace is adapted to move with a firefighter and float with respect of said torso portion.

13. Firefighter's pants as defined in claim 12 wherein the connecting members on the front part of said torso portion comprise a pair of spaced connecting members, the connecting members on said back brace comprising a similarly spaced pair of connecting members.

14. Firefighter's pants as defined in claim 10 including a plurality of straps permanently connected to the rear part of Said torso portion, each of said straps defining a loop within which the central part of the back brace is slidably disposed so that the back brace is adapted to move with a firefighter and and move laterally with respect to said torso portion.

15. Firefighter's pants as defined in claim 14 wherein there are three spaced straps, said first connecting means comprising a connecting member fixed to the middle one of said straps and an interengaging connecting member fixed to said rear panel.

* * * * *